US009889683B2

(12) United States Patent
Masuda

(10) Patent No.: US 9,889,683 B2
(45) Date of Patent: Feb. 13, 2018

(54) SHEET CUTTING APPARATUS AND IMAGE FORMING APPARATUS

(71) Applicant: TOSHIBA TEC KABUSHIKI KAISHA, Shinagawa-ku, Tokyo (JP)

(72) Inventor: Ken Masuda, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/332,178

(22) Filed: Oct. 24, 2016

(65) Prior Publication Data

US 2017/0036463 A1 Feb. 9, 2017

Related U.S. Application Data

(62) Division of application No. 14/288,645, filed on May 28, 2014.

(51) Int. Cl.

| | |
|---|---|
| ***B41J 11/70*** | (2006.01) |
| ***B41J 3/407*** | (2006.01) |
| ***B26D 1/08*** | (2006.01) |
| ***B26D 5/20*** | (2006.01) |

(52) U.S. Cl.

CPC ..... *B41J 11/70* (2013.01); *B26D 1/085* (2013.01); *B26D 5/20* (2013.01); *B41J 3/4075* (2013.01); *Y10T 83/04* (2015.04); *Y10T 83/485* (2015.04); *Y10T 83/492* (2015.04)

(58) Field of Classification Search

CPC . B26D 1/065; B26D 5/26; B26D 5/20; B26D 1/085; B41J 11/70; B41J 3/4075; Y10T 83/492; Y10T 83/485

See application file for complete search history.

(56) References Cited

U.S. PATENT DOCUMENTS

| | | | |
|---|---|---|---|
| 4,748,884 | A | 6/1988 | Planeta |
| 5,781,207 | A | 7/1998 | Hasegawa et al. |
| 5,871,429 | A | 2/1999 | Harding et al. |
| 6,264,304 | B1 | 7/2001 | Iwaya et al. |
| 6,503,009 | B2 | 1/2003 | Naitou |
| 2002/0024553 | A1 | 2/2002 | Nishioka et al. |

(Continued)

FOREIGN PATENT DOCUMENTS

| | | |
|---|---|---|
| CN | 101546440 | 9/2009 |
| JP | 2013-056384 | 3/2013 |

*Primary Examiner* — David Banh

(74) *Attorney, Agent, or Firm* — Amin, Turocy & Watson LLP

(57) ABSTRACT

A sheet cutting apparatus includes a cutting position where a sheet is cut; a guillotine type cutter configured to move between the cutting position and a home position above the cutting position; a motor; a drive mechanism configured to transfer a drive force from the motor to the cutter to move the cutter between the home position and the cutting position; a drive control section configured to enable the cutter to fall from the home position to the cutting position when cutting a sheet by the cutter and then return the cutter to the home position; a determination section configured to determine whether or not a given period of time elapses from the last return completion of the cutter to the home position; and a return control section configured to return the cutter to the home position if the determination section determines that a given period of time elapses from the last return completion of the cutter to the home position.

2 Claims, 13 Drawing Sheets

(56) References Cited

U.S. PATENT DOCUMENTS

| | | | | |
|---|---|---|---|---|
| 2009/0245914 | A1 | 10/2009 | Shibasaki et al. | |
| 2010/0060705 | A1* | 3/2010 | Masuda | B41J 2/32 347/218 |
| 2012/0057918 | A1 | 3/2012 | Eoka | |
| 2012/0210838 | A1 | 8/2012 | Maeyama et al. | |

* cited by examiner

FIG.12

| DATE | PRINTING TIMES (TIMES) | ACCUMULATED PRINTING TIMES (TIMES) |
|---|---|---|
| JULY 11th | 100 | 100 |
| JULY 12th | 200 | 300 |
| JULY 13th | 300 | 600 |
| JULY 14th | 400 | 1000 |
| JULY 15th | 500 | 1500 |
| JULY 16th | 600 | 2100 |
| JULY 17th | 700 | 2800 |

| PRINTING TIMES | X (min) |
|---|---|
| 1000000 | 60min |
| 2000000 | 50min |
| 3000000 | 40min |
| 4000000 | 30min |
| 5000000 | 20min |

FIG.13

SHEET CUTTING APPARATUS AND IMAGE FORMING APPARATUS

CROSS-REFERENCE TO RELATED APPLICATIONS

This application is a Division of application Ser. No. 14/288,645 filed May 28, 2014, the entire contents of all of which are incorporated herein by reference.

FIELD

Embodiments described herein relate to a technology in which the occurrence of a defect caused by the falling of a cutter in a guillotine type sheet cutting apparatus from a specific standby position as time goes by is prevented.

BACKGROUND

For example, in a guillotine type sheet cutting apparatus carried in a printer, a sheet is cut by a cutter which is driven in a vertical direction by a motor.

In the guillotine type sheet cutting apparatus, the cutter waits at a home position when carrying out no cutting operation and falls to a sheet below to cut the sheet by a guillotine operation when carrying out a cutting operation.

After cutting the sheet, the cutter is lifted to the home position again to wait for a next cutting operation.

However, in the guillotine type sheet cutting apparatus, the cutter, if made to wait at the home position for along time, may fall slowly in a direction of gravity under the effect of a vibration applied to the sheet cutting apparatus and the holding torque of a motor for driving the cutter.

The cutter, which falls slowly from the home position as time goes by as stated above, projects into a conveyance path for conveying a sheet to be cut, thus, the sheet cutting apparatus hinders the conveyance of a sheet conveyed to a position below the cutter to be cut, which may lead to the occurrence of a sheet block (the called jam).

BRIEF DESCRIPTION OF THE DRAWINGS

FIG. 12 is a diagram exemplarily illustrating an accumulated printing times of an image forming apparatus; and FIG. 13 is a diagram exemplarily illustrating the relation between an accumulated printing times and elapsed time X.

DETAILED DESCRIPTION

Generally, in accordance with one embodiment, a sheet cutting apparatus includes a cutting position, a cutter, a motor, a drive mechanism, a drive control section, a determination section and a return control section.

A sheet is cut at the cutting position

The cutter, which is of a guillotine type, moves between the cutting position and a home position above the cutting position.

The drive mechanism transfers a drive force from the motor to the cutter to move the cutter between the home position and the cutting position.

The drive control section enables the cutter to fall from the home position to the cutting position when cutting a sheet by the cutter and then return the cutter to the home position.

The determination section determines whether or not a given period of time elapses from the last return completion of the cutter to the home position.

The return control section returns the cutter to the home position if the determination section determines that a given period of time elapses from the last return completion of the cutter to the home position.

A First Embodiment

A first embodiment is described first with reference to accompanying drawings.

Figure 1:
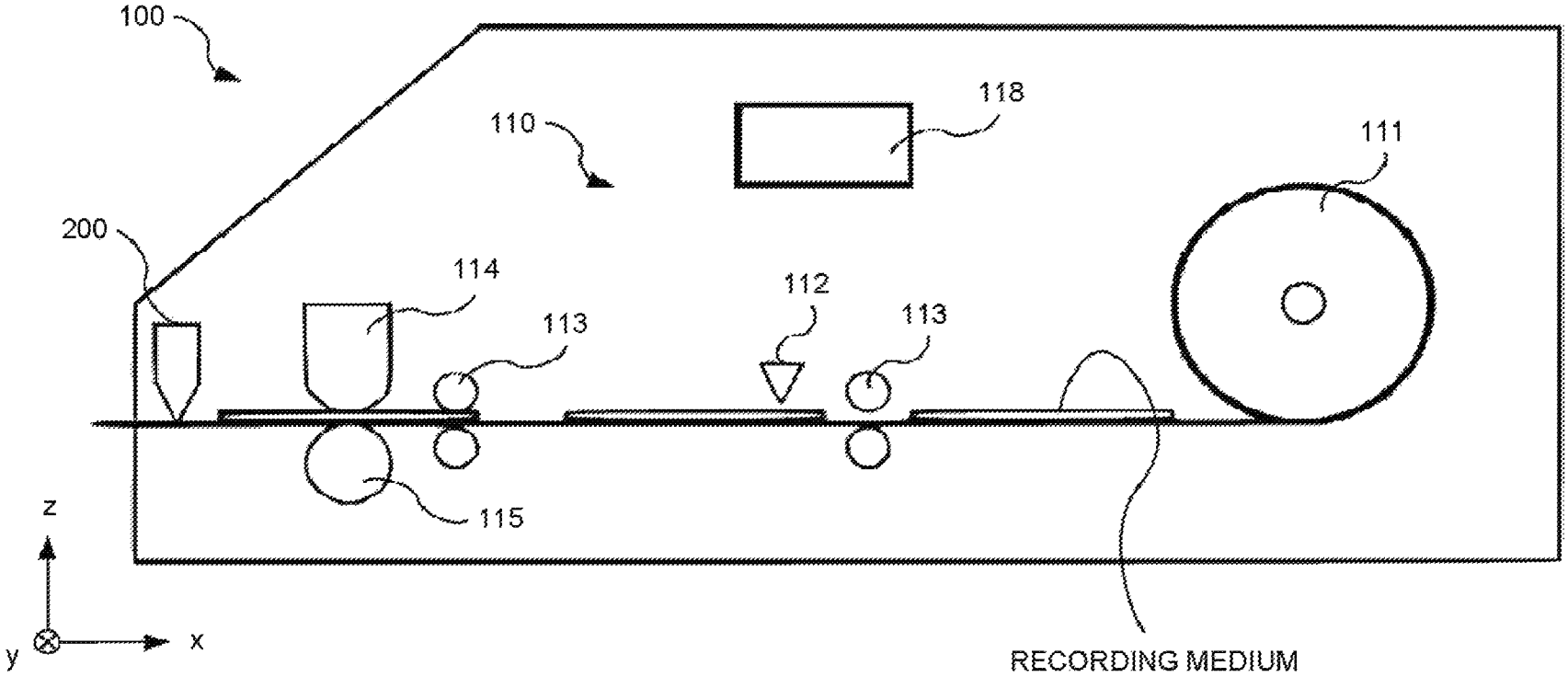
FIG. 1 is a sectional view illustrating a constitution of an image forming apparatus.

FIG. 1 is a sectional view illustrating a constitution of an image forming apparatus. As shown in FIG. 1, an image forming apparatus 100 of the present embodiment comprises a recording medium conveyance mechanism 113 configured to convey a roll recording medium 111; a head 114 configured to form an image on the recording medium 111; a platen 115 configured at a position opposite to the head 114 across a recording medium conveyance path; a sheet cutting apparatus 200 configured at a position more downstream than the head 114 along the recording medium conveyance direction; and a control section 118 configured to control operations of the sheet cutting apparatus 200.

When the recording medium 111 is label paper, the image forming apparatus 100 may comprise a gap sensor 112 for detecting the gap between labels.

The control section 118 further controls operations of the recording medium conveyance mechanism 113 and the head 114.

Figure 2:
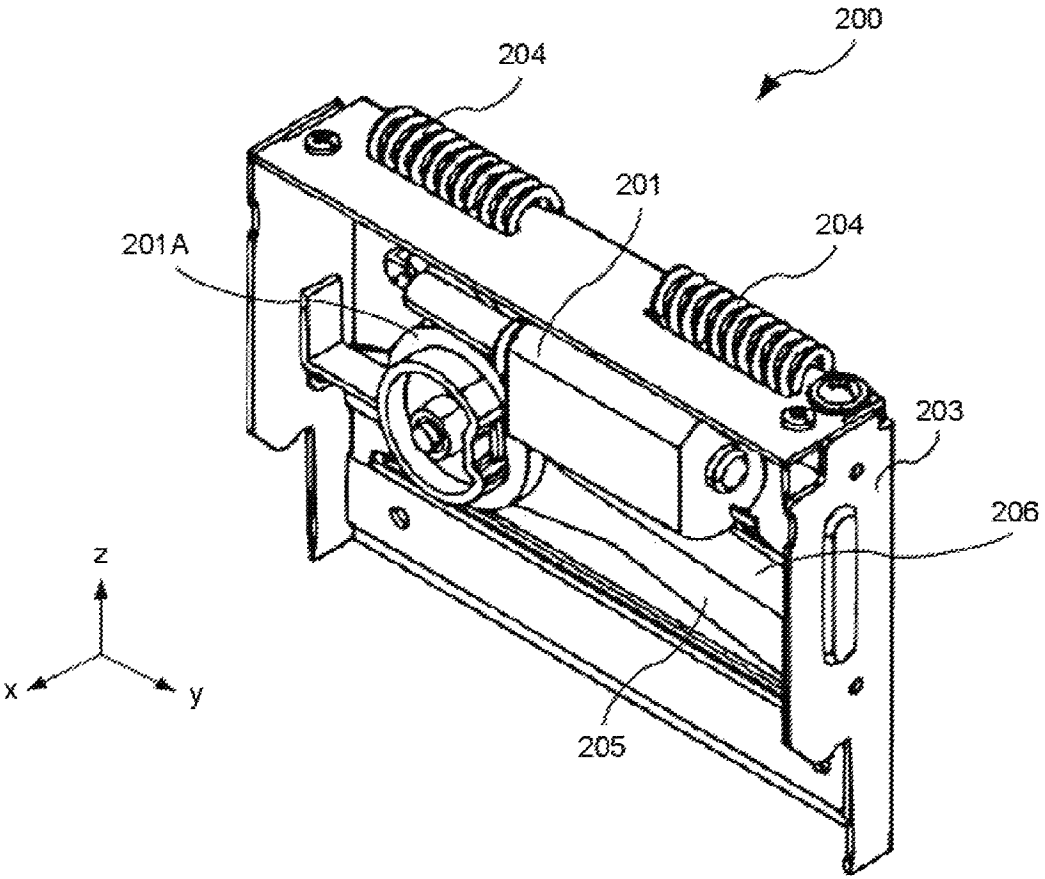
FIG. 2 is a perspective view of a sheet cutting apparatus.
Figure 3:
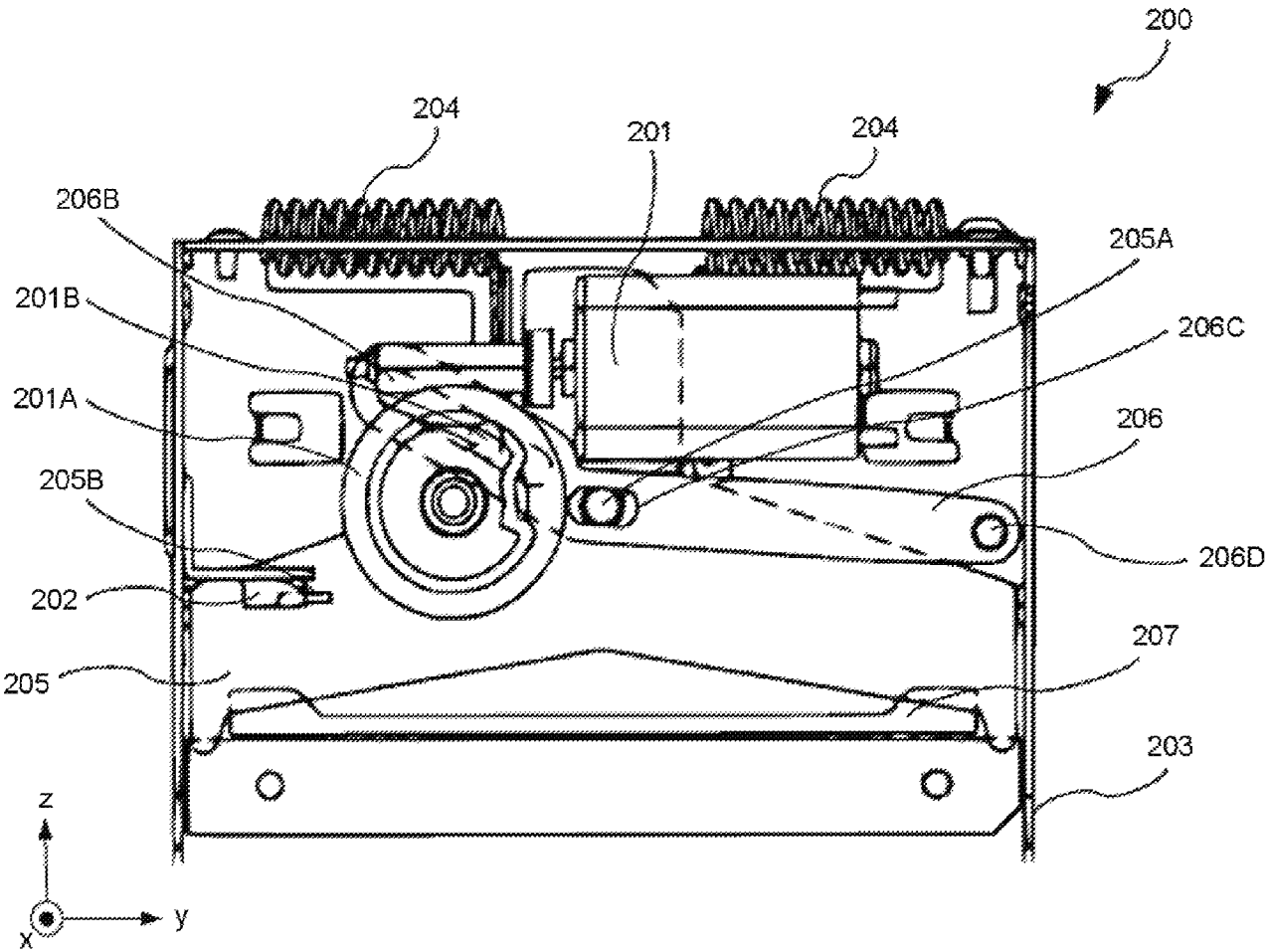
FIG. 3 is a back view illustrating a sheet cutting apparatus the cutter of which is at a home position.
Figure 4:
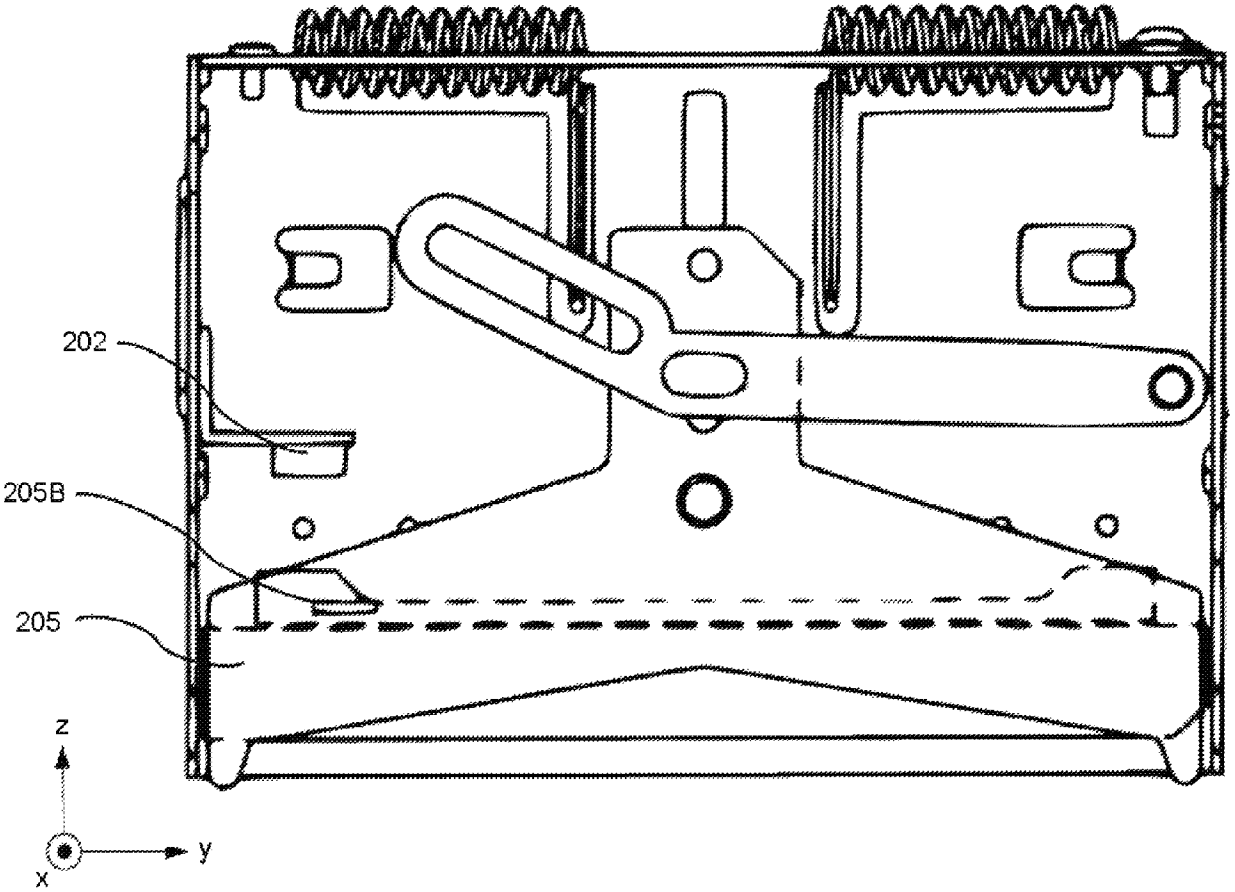
FIG. 4 is a back view illustrating a sheet cutting apparatus the cutter of which is at a cutting completion position.

FIG. 2 is a perspective view illustrating a drive mechanism of the cutter 205 in the sheet cutting apparatus 200. Further, FIG. 3 is a back view illustrating the sheet cutting apparatus 200 the cutter 205 of which is at a home position, and FIG. 4 is a back view illustrating the sheet cutting apparatus 200 the cutter 205 of which is at a cutting completion position (the lowest position in a cutting operation). Further, for the sake of convenience of description, a gear 201A and a cutter drive section 201 which will be described later are saved in FIG. 4.

In the present embodiment, the sheet cutting apparatus 200 is described as an example which cuts a recording medium by displacing the cutter 205 in a vertical direction towards the recording medium, however, the sheet cutting apparatus 200 may not be an apparatus of this type.

As shown in FIG. 2-FIG. 4, the sheet cutting apparatus 200 comprises an elastic body 204 locked to a frame 203; a cutter 205 connected with the elastic body 204; a cutter drive section 201 for driving the cutter 205; a gear 201A driven to rotate by the cutter drive section 201; a pin 201B arranged on the radius of the gear 201A; a lever 206 which has a pin inserting hole 206B on one end into which the pin 201B is inserted and a drive hole 206C in the center part into which a drive pin 205A of the cutter 205 is inserted, and is rotationally supported by the frame 203 through a fulcrum 206D on the other end; a home position sensor 202 for detecting a detection hole 205B of the cutter 205; and fixed teeth 207 fixed on the frame 203.

The elastic body 204 consisting of a spring urges the cutter 205 away from the recording medium 111.

The cutter drive section 201 may be a DC motor, a stepping motor and the like.

The home position sensor 202 detects whether or not the cutter 205 is at the home position, that is, a position furthest from the fixed teeth 207 (e.g. the state shown in FIG. 3), by detecting the light through the detection hole 205B. Further, the home position sensor 202 is exemplarily described as an optical sensor herein, however, it is not limited to this, it may also be, for example, a mechanical sensor.

If the cutter drive section 201 carries out a drive operation, then the gear 201A mounted on a rotation shaft of the cutter drive section 201 rotates. If the gear 201A rotates, then the pin 201B rotates and the lever 206 is displaced downward. The lever 206 rotates downward by taking the fulcrum 206D as a fulcrum, in this way, the pin inserting hole 206B becomes a force point and the drive hole 206C becomes an action point, thereby displacing the cutter 205 downward to the cutting completion position.

The recording medium 111 is conveyed between the cutter 205 and the fixed teeth 207. Therefore, the recording medium 111 is cut by the cutter 205 and the fixed teeth 207. At this time, the cutter 205 is at the position shown in FIG. 4.

If the cutter drive section 201 further carries out a drive operation, then the pin 201B moves upwards to lift the lever 206. The lever 206 rotates upwards by taking the fulcrum 206D as a fulcrum, then the drive pin 205A is lifted and the cutter 205 is returned to the home position.

Figure 5:
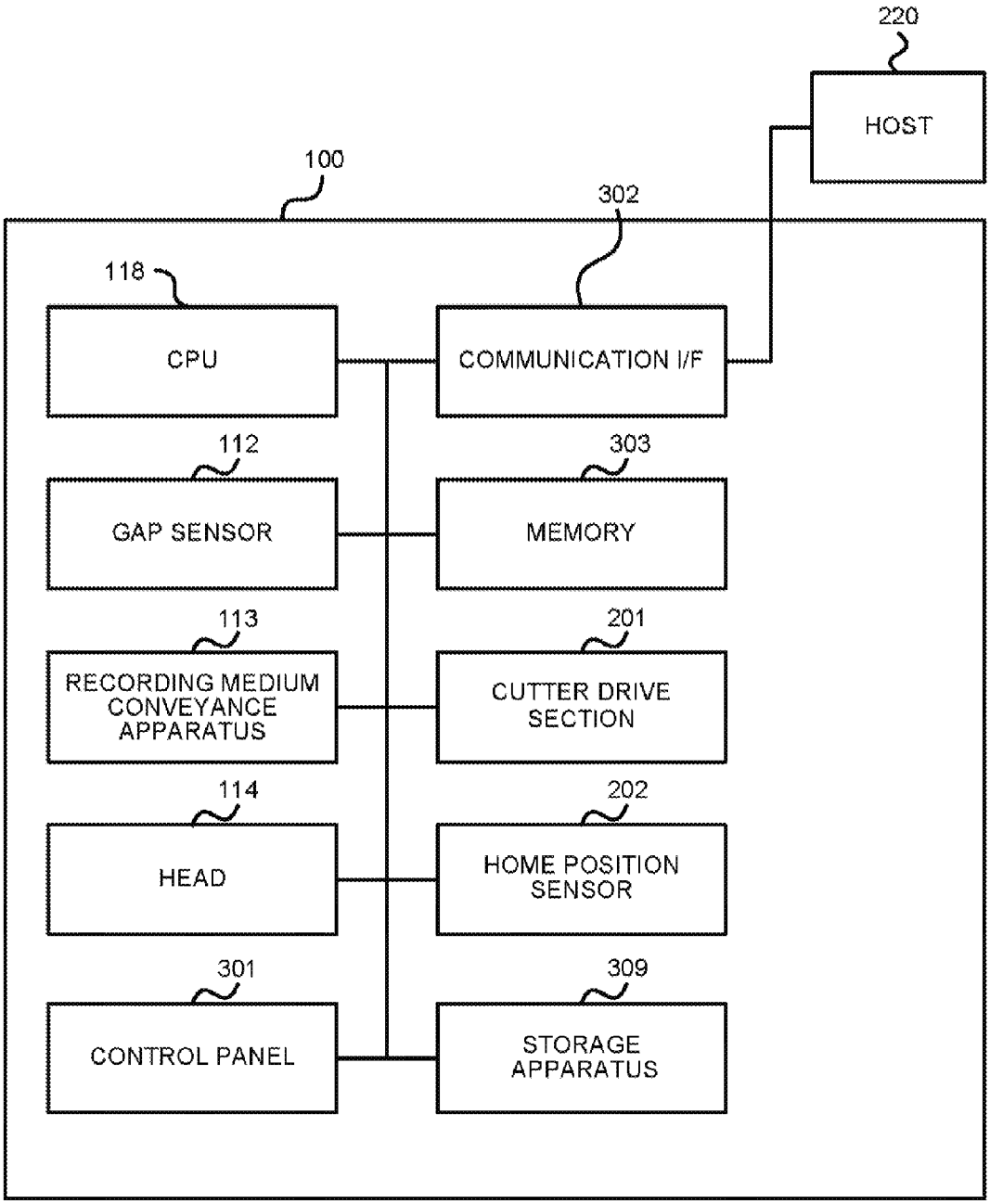
FIG. 5 is a block diagram illustrating a constitution of an image forming apparatus.

FIG. 5 is a block diagram illustrating a constitution of the image forming apparatus 100. As shown in FIG. 5, the image forming apparatus 100 comprises a CPU 118 serving as a control section; a gap sensor 112; a recording medium conveyance mechanism 113; a head 114; a control panel 301 serving as an input/output apparatus; a communication interface 302 (hereinafter interface is referred to as I/F) communicating with an external apparatus; a memory 303; a cutter drive section 201; a home position sensor 202; and a storage apparatus 309 consisting of a hard disc drive.

The control section 118 communicates with a host computer 220 (hereinafter referred to as a HOST) through the communication I/F 302.

The control section 118 acquires, for example, the detection signals in the gap sensor 112 and the home position sensor 202 and controls the recording medium conveyance mechanism 113, the head 114 and the cutter drive section 201. The various processing carried out by the control section 118 herein can be realized by executing various programs loaded in the memory 303 using the control section 118 serving as a CPU. Part of or all the various programs that should be executed in the sheet cutting apparatus may be stored in, for example, the storage apparatus 309.

Figure 6:
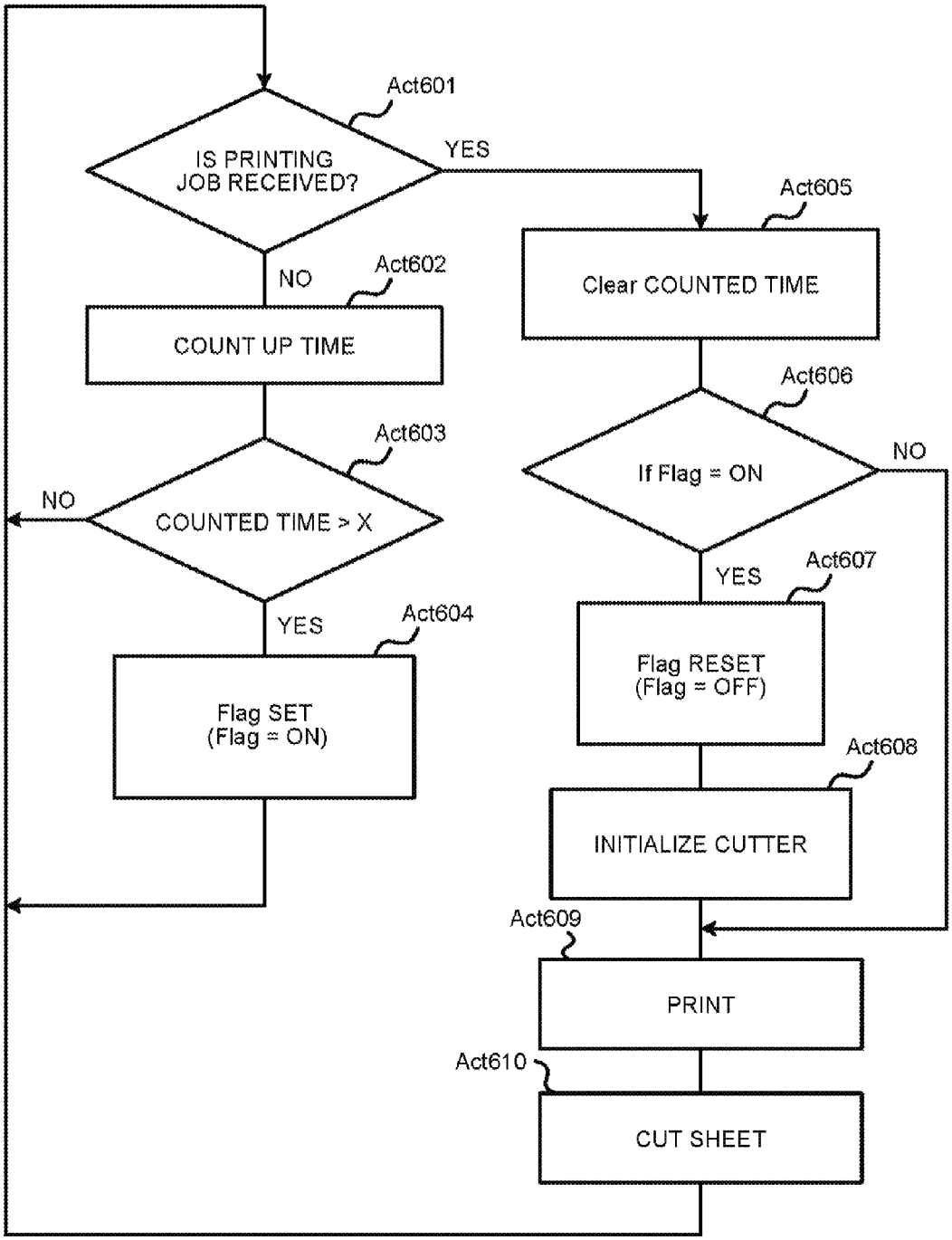
FIG. 6 is a flowchart illustrating operations of a sheet cutting apparatus.

FIG. 6 is a flowchart illustrating the operations of a cutter apparatus.

After the former printing operation is ended, if the image forming apparatus 100 receives a printing job in ACT 601 (YES in ACT 601), the flow proceeds to ACT 605. On the other hand, the flow proceeds to ACT 602 if no printing job is received (NO in ACT 601).

In ACT 602, the control section 118 (determination section) starts to count up the elapsed time X elapsing from the ending time of the former printing operation.

In ACT 603, if the control section 118 (determination section) determines that the counted time is longer than the elapsed time X (YES in ACT 603), the flow proceeds to ACT 604. The elapsed time X may be set to, for example, 60 min. On the other hand, the flow returns to ACT 601 if the control section 118 (determination section) determines that the counted time is shorter than the elapsed time X (NO in ACT 603).

In ACT 604, the control section 118 sets a flag and then the flow returns to ACT 601.

In ACT 605, the control section 118 clears the time counted up from ACT 602, and then the flow proceeds to ACT 606. That is because if the count of the timer is not reset, the operation in ACT 608 (the return operation of the cutter to the home position) is carried out every time the image forming apparatus carries out a printing operation. If the cutter is initialized every time a printing operation is carried out, then it will take a long time from the moment a printing job is received to the moment the printing job is finished.

In ACT 606, the control section 118 determines whether or not a flag is set in ACT 604, if a flag is set in ACT 604, the flow proceeds to ACT 607. On the other hand, if no flag is set, the control section 118 makes the flow proceed to ACT 609.

In ACT 607, the control section 118 resets the flag set in ACT 604. That is because if the flag is not reset, then the cutter initialization in ACT 608 is carried out every time a printing operation is carried out.

In ACT 608, the control section 118 (return control section) initializes the cutter. Specifically, the cutter 205 in the sheet cutting apparatus 200 is lifted and returned to the home position. In this way, it is prevented that the cutter 205 falling from the home position as time goes by contacts with a sheet conveyed as a target to be cut. The initialization of the cutter is carried out immediately before the sheet is cut, therefore, the contact between the cutter and the sheet is surely prevented. That is because if the cutter is initialized immediately before the sheet is cut, then the possibility is reduced that the cutter falls again after returned to the home position and contacts with the sheet.

In ACT 609, the control section 118 controls to form an image on the sheet.

In ACT 610, the control section 118 (drive control section) drives the cutter drive section 201 to cut the conveyed sheet at a cutting position.

Figure 7:
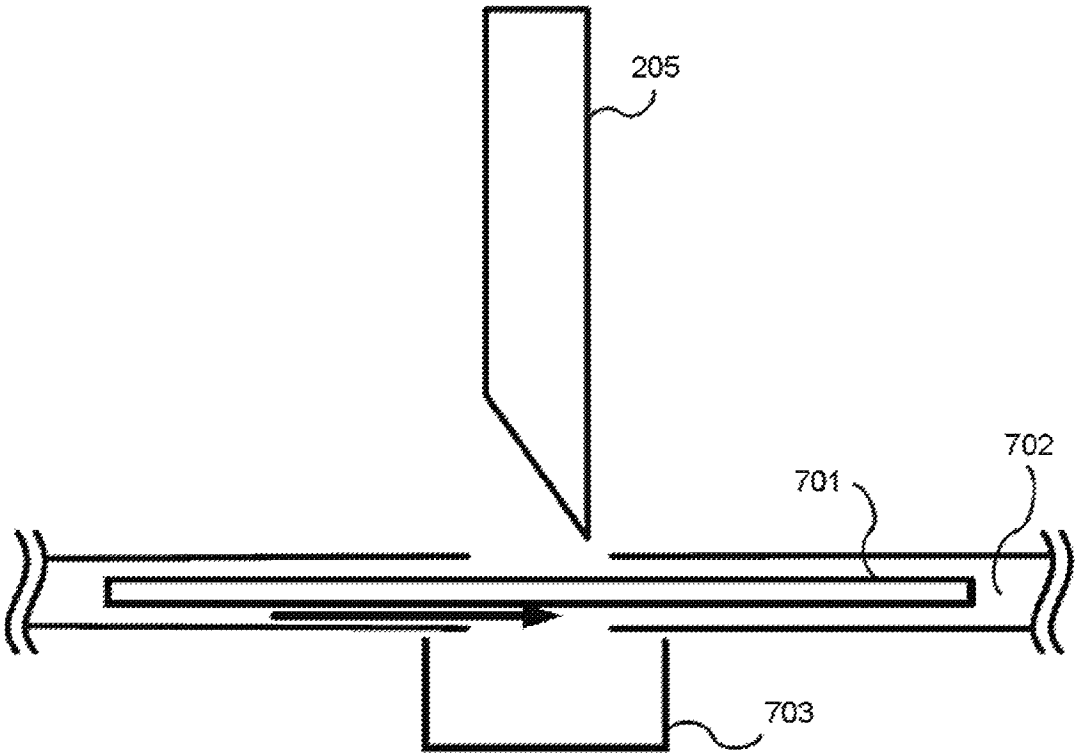
FIG. 7 is a schematic diagram illustrating a sheet cutting apparatus the cutter of which is at a home position.
Figure 8:
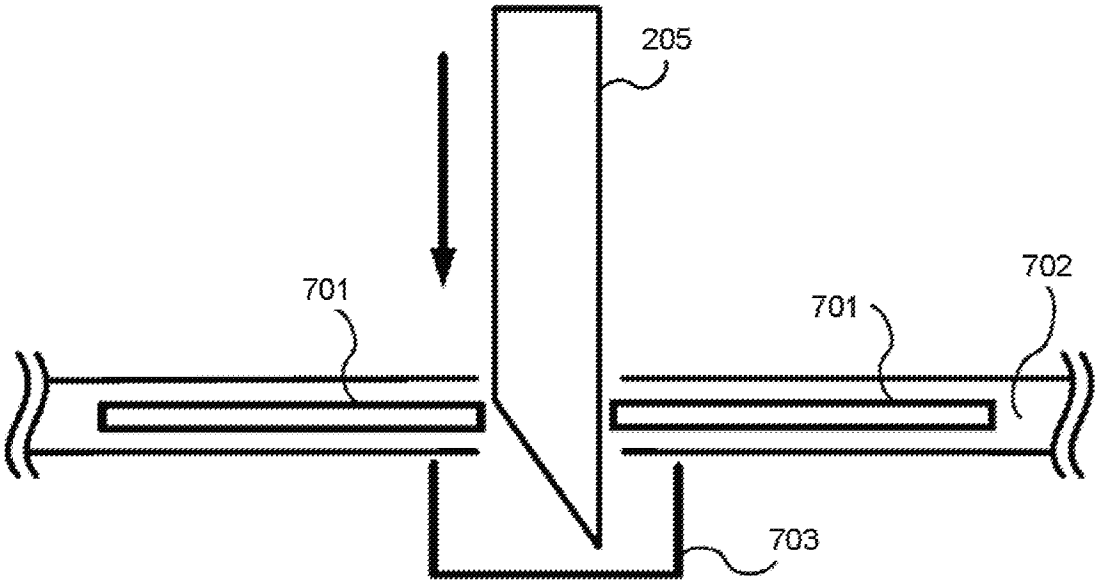
FIG. 8 is a schematic diagram illustrating a sheet cutting apparatus cutting a sheet.
Figure 9:
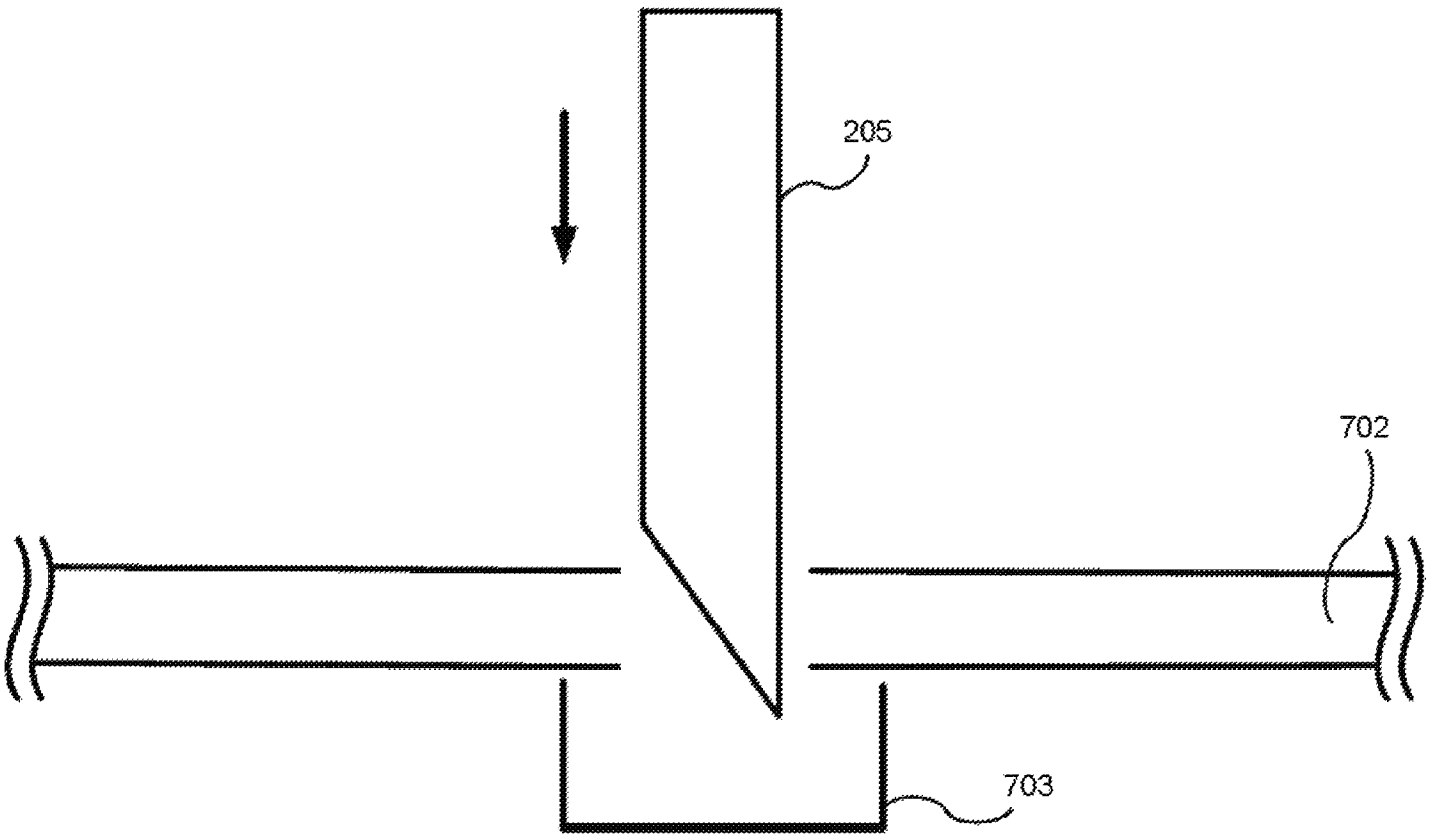
FIG. 9 is a schematic diagram illustrating a sheet cutting apparatus the cutter of which falls.
Figure 10:
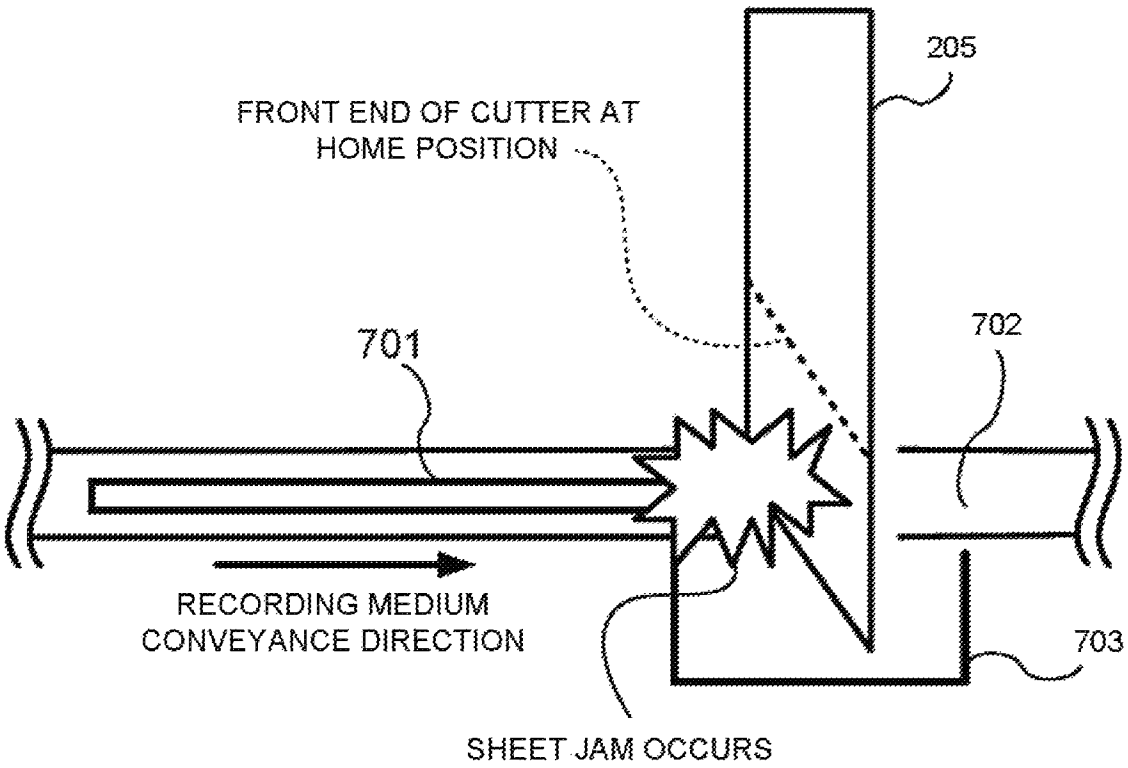
FIG. 10 is a schematic diagram illustrating a sheet cutting apparatus which causes a sheet jam.

The cutter initialization operation in ACT 608 shown in FIG. 6 is described below in detail. As shown in FIG. 7, a sheet 701 serving as a printing medium moves in a sheet conveyance path 702 and stops at a cutting position, and the cutter 205 falls vertically. Then, the sheet 701 is cut, as shown in FIG. 8. However, as shown in FIG. 9, if the cutter 205 falls as time goes by or falls due to other reason, the contact between the conveyed sheet 701 with the fallen cutter 205 causes a jam, as shown in FIG. 10.

In ACT 602 shown in FIG. 6, the elapsed time X serving as a trigger for the cutter initialization may not be counted up based on the printing completion. For example, the moment when the cutter 205 returns to the home position last time may be taken as the trigger. Further, for example, the moment the former printing job is received maybe taken as the trigger to count up the elapsed time X.

The count of the timer described in ACT 605 shown in FIG. 6 is not necessarily to be cleared after the printing job is received in ACT 601 and before the flag determination in ACT 606, it can be cleared at any action after a printing job is received and before a printing operation is ended.

The flag reset in ACT 607 shown in FIG. 6 is not necessarily to be carried out after the flag determination in ACT 607 and before the cutter initialization in ACT 608, it can be carried out at any action after the flag determination in ACT 606 and before the flag setting in ACT 604.

A Second Embodiment

Next, a second embodiment is described with reference to accompanying drawings. As a modification of the first embodiment, the basic apparatuses constitution in the second embodiment is the same as that in the first embodiment. A member having the same function as one described in the first embodiment is hereinafter denoted by the same reference sign and is therefore not described repeatedly.

The motor and the drive mechanism, after being used for many times, will deteriorate as time goes by. The deterioration of such a drive mechanism will make it easy for the cutter waiting at the home position to move downward or contrarily make it hard for the cutter at the home position to move.

Therefore, due to the deterioration state of the motor and the drive mechanism, it is necessary to control the return operation of the cutter to the home position after a given time X elapses.

Figure 11:
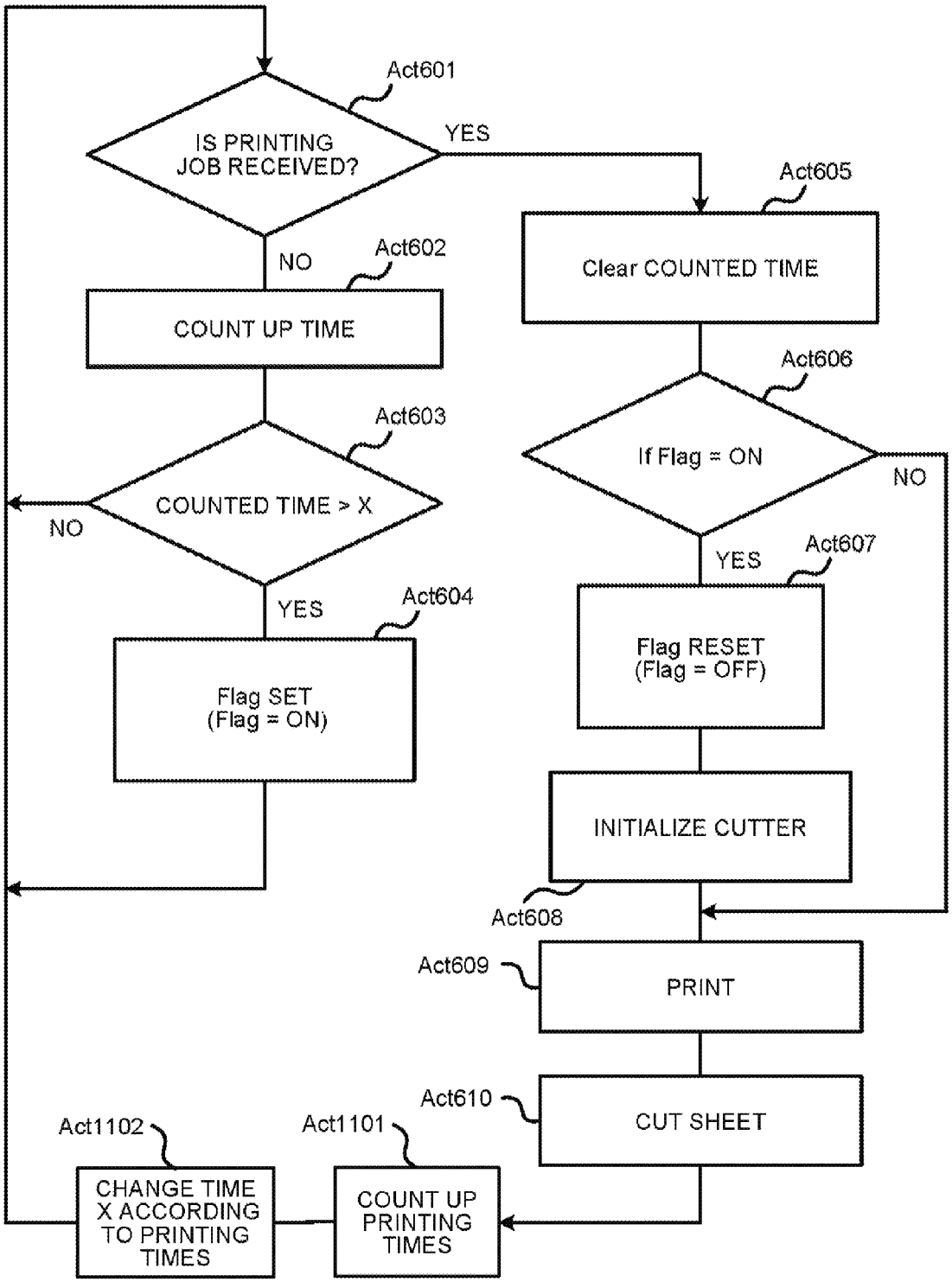
FIG. 11 is a flowchart illustrating operations of a sheet cutting apparatus.

FIG. 11 is a flowchart illustrating the operations of a sheet cutting apparatus according to the second embodiment. Further, a case where a cutter waiting at a home position falls easily since a drive mechanism is deteriorated after repeating a cut operation in a sheet cutting apparatus is listed herein as an example.

After the printing operation in ACT 609 is ended, a printing times counter counts the printing times of the image forming apparatus 100 in ACT 1101. The printing times refers to an accumulated printing times carried out in the image forming apparatus. FIG. 12 is a table illustrating an accumulated printing times.

In ACT 1102, the control section 118 (timer control section) changes, according to the printing times counted in ACT 1101, the elapsed time X, which serves as a trigger for the cutter initialization in ACT 609, elapsing from the completion of the former printing operation.

Herein, if the elapsed time X elapsing from the former printing operation and serving as a trigger for the cutter initialization is specified, then the cutter 205 falls to a height (the height of the front end of the cutter in the sheet conveyance path), which may cause a sheet jam, before the elapsed time X elapses, which may lead to a contact with the conveyed sheet 701. Thus, in order to prevent the contact between the cutter 205 which is likely to fall as deteriorated after being used for a long time with a conveyed sheet 701, the elapsed time is shortened corresponding to an increase in printing times. The relation between the printing times and the elapsed time X is presented by, for example, a table shown in FIG. 13. The value of the elapsed time X decreases as the printing times increases.

Further, it is preferred that the printing times are reset after the motor and the drive mechanism used in the sheet cutting apparatus 200 are replaced or maintained. The elapsed time X is changed because the deterioration of the motor and the drive mechanism occurring as time goes by is taken into consideration.

Further, a case where the repeated cutting operation of the sheet cutting apparatus makes it easy for a cutter waiting at a home position to fall is exemplarily illustrated herein, on the contrary, in a case where the deterioration of a drive mechanism due to the repeating of the cutting operation makes it hard for the cutter waiting at the home position to move, the given time X may be increased in response to an increase in a printing times (that is, the cutting times by the cutter).

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to form an image on a sheet;

a sheet conveyance section configured to convey the sheet on which an image is formed by the image forming section to the downstream side of a specific sheet conveyance direction;

a guillotine type cutter configured to move between a cutting position where the sheet conveyed by the sheet conveyance section and formed with an image by the image forming section is cut and a home position above the cutting position;

a motor;

a drive mechanism configured to transfer a drive force from the motor to the cutter to move the cutter between the home position and the cutting position;

a drive control section configured to enable the cutter to fall from the home position to the cutting position and then return the cutter to the home position;

a determination section configured to determine whether or not a predetermined time lapses after the image forming processing is completed by the image forming section based on the drive control section;

a return control section configured to return the cutter to the home position if the determination section determines that a given period of time elapses from the time when the last image forming processing by the image forming section is ended;

a counter configured to count the drive times the drive control section drives the cutter; and a set period changing section configured to change the given period of time based on the drive times counted up by the counter;

wherein the set period changing section shortens the given period of time in response to an increase in the drive times counted by the counter.

2. The image forming apparatus according to claim 1, wherein the return control section returns the cutter to the home position during the period from the moment an instruction of executing a current image forming processing by the image forming section is received to the moment the image forming processing is started, if the determination section determines that a given period of time elapses from the time when the last image forming processing by the image forming section is ended.

* * * * *